United States Patent [19]

Spurlock, Jr. et al.

[11] Patent Number: 4,763,376

[45] Date of Patent: Aug. 16, 1988

[54] MAINTENANCE INSPECTION SUBMERSIBLE TRANSPORT APPARATUS

[75] Inventors: Edwin C. Spurlock, Jr., Boynton Beach; William M. O'Neill, Lighthouse Point, both of Fla.

[73] Assignee: Pene-Tech, Inc., West Palm Beach, Fla.

[21] Appl. No.: 867,086

[22] Filed: May 27, 1986

[51] Int. Cl.[4] ..... B08B 9/04

[52] U.S. Cl. ..... 15/104.31; 15/104.09; 15/104.13; 134/167 C; 241/159

[58] Field of Search ..... 15/104.09, 104.1 R, 15/104.12, 104.13, 104.14, 104.3 R; 241/159

[56] References Cited

U.S. PATENT DOCUMENTS 4,027,349 6/1977 Clavin ..... 15/104.12
4,418,437 12/1983 French ..... 15/104.09

FOREIGN PATENT DOCUMENTS 0052270 5/1982 European Pat. Off. ..... 15/104.3 R
3025586 1/1982 Fed. Rep. of Germany ..... 15/104.3 R

*Primary Examiner*—Edward L. Roberts
*Attorney, Agent, or Firm*—Jack N. McCarthy

[57] ABSTRACT

A pipe cleaning apparatus for cleaning large diameter pipe comprises a frame coaxially supported within the pipe. A plurality of legs and arms are mounted to the frame and are extendible to engage the interior surface of the pipe. The legs include drive wheels for advancing the apparatus through the pipe. The arms include attachments mounted on the distal end thereof for cleaning and inspection of the interior surface of the pipe. Multiplexing and electrical power is provided to the apparatus from a remote control facility. A hydrolift assembly suspended from the bottom of the apparatus is provided to remove debris accumulated in the pipe. A one atmosphere detachable vessel may be mounted to the frame for transporting divers to the work site within the pipe.

9 Claims, 3 Drawing Sheets

FIG. 4
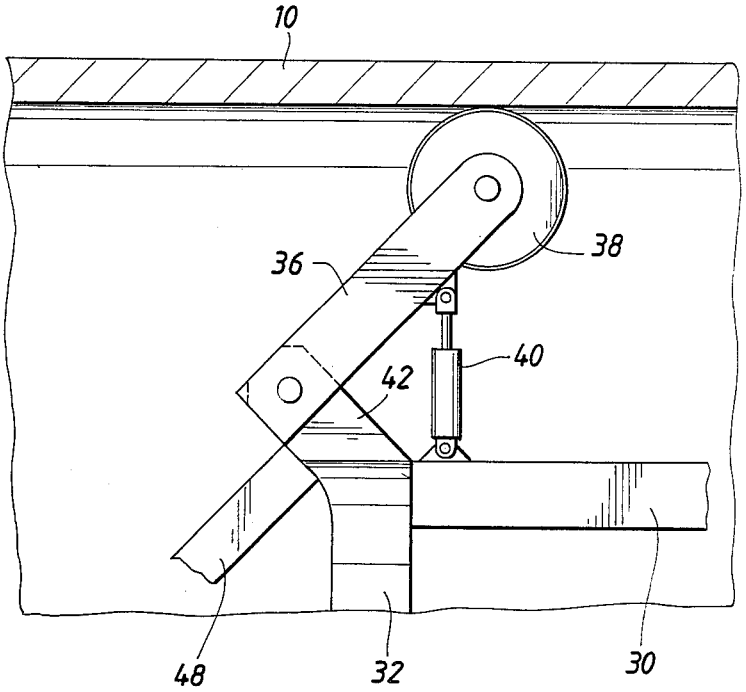
FIG.5
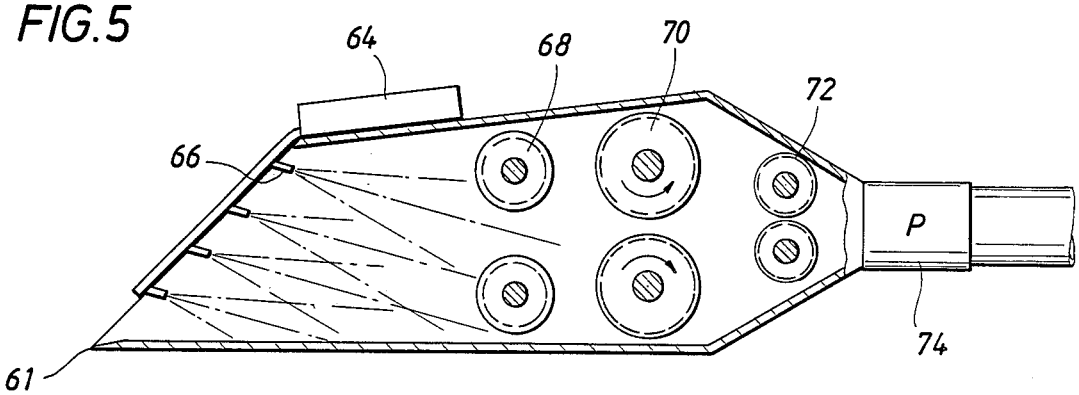
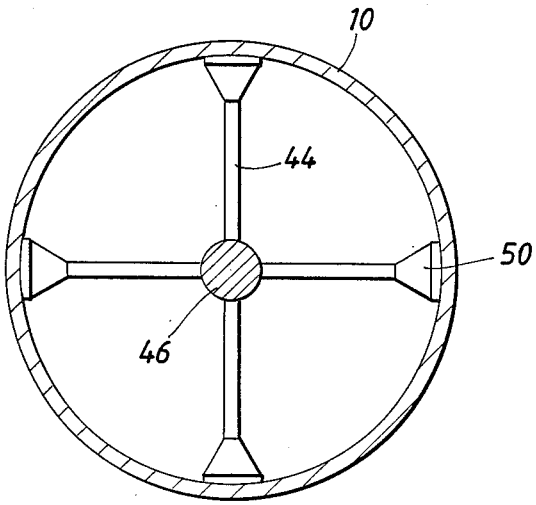
FIG.6

MAINTENANCE INSPECTION SUBMERSIBLE TRANSPORT APPARATUS

BACKGROUND OF THE DISCLOSURE

This invention relates to pipe cleaning apparatus, particularly, to an apparatus for cleaning large diameter pipe forming a fresh or salt water system.

It is well known that the cleaning, repair and inspection of large diameter pipelines is a very difficult, expensive and time consuming task. Various devices and processes have been developed to aid in the removal of marine growth and other foreign material from pipelines of municipal water systems or the like. These prior art devices and methods have met with varying degrees of success. However, none have provided totally satisfactory results. Almost every pipeline, regardless of whether it is in salt water or fresh water, will have some type of marine growth. Therefore, cleaning, repairing and inspection of pipelines is a continual problem faced by pipeline operators and municipalities.

One prior art method of cleaning large diameter pipelines uses the Phosmarine Brush-Cart, an apparatus similar to apparatus used to clean super tankers. The Brush-Cart has several brushes on its under surface that form a suction for engaging the pipeline wall. The Brush-Cart is guided by a diver the full length of the pipeline. This is a very time consuming procedure because the cart only cleans approximately three feet of the inside diameter of the pipeline with each pass. For a pipeline having a twelve foot inside diameter, the Brush-Cart must be run the full length of the pipeline six to eight times to completely clean the pipeline. Another disadvantage associated with the Phosmarine Brush-Cart method of cleaning pipelines is that divers are required to guide or steer the Brush-Cart along the pipeline. Also, the divers require a long period of time for decompression, which is both dangerous to the divers and increases the cost of the pipe cleaning operation. After the marine growth or other foreign material has been removed from the wall of the pipeline, the debris must be moved to the end of the pipeline and then air lifted or otherwise removed from the pipeline. Removal of the debris can often take much longer than the cleaning operation itself. The final step is inspection of the pipeline which is usually done by a diver walking the length of the pipe with a video camera. This is a time consuming procedure and results only in a spot check of the pipeline.

The hydrolaser has also been used to clean pipelines. The hydrolaser is a steel frame mounted on skids having six high pressure water jets to clean the growth or other debris in the pipeline. A disadvantage associated with this method of pipe cleaning is that the high pressure water jets also tend to cut or abrade the walls of the pipeline. In addition, after use of the hydrolaser, the loose debris must be removed from the pipeline, thereby adding to the duration and expense of the cleaning operation.

Pipelines have also been cleaned by divers using hand-held hydraulic cutter heads. This method cleans the growth and removes the foot print from the walls without doing damage to the pipe. If the foot print is not removed, barnacles will grow back in half the time. Removal of loose debris is accomplished by divers with air lifts. Inspection is done by a diver walking within the pipeline with a hand-held video camera. Because of the adverse working conditions, it is difficult for divers to completely clean the pipeline using hand-held hydraulic cutter heads.

It is, therefore, an important object of this invention to provide a multi-functional apparatus for cleaning pipelines and removing debris in one pass of the pipeline.

Another object of the invention is to provide for inspection of the pipeline via color video camera with video tape or still photographs. On site inspection is provided by a one-atmosphere capsule adapted to transport up to three divers for visual inspection of the pipeline.

Still another object of the invention is to provide safe on-site diver support for up to three divers conducting operations in the pipeline. In addition, it is an object of the invention to provide transport for personnel to and from the work site in a warm, dry environment, thereby greatly increasing diver production.

SUMMARY OF THE INVENTION

The invention of the present disclosure is directed to a pipeline cleaning system comprising a pipe cleaning apparatus, a computerized remote control facility, and an umbilical and independent power unit. The cleaning apparatus includes a frame structure aubstantially defining a cylindrical shape adapted to be received within a pipeline or conduit. The frame structure is positioned in the conduit by eight adjustable legs located about the front and rear ends of the frame structure. The legs are moved in and out by a hydraulic actuator attached to each leg. A wheel at the terminus of each leg is constructed of an abrasive rubber to insure proper traction for engaging the interior surface of the conduit and advancing the frame structure through the conduit. Four hydraulic arms mounted at the forward end of the frame structure rotate clockwise or counterclockwise for cleaning circular conduits. The arms are adjustable and may be extended in or out to meet the wall of the surrounding conduit. A wide variety of attachments may be mounted to the distal ends of the arms for maintenance, cleaning and inspection of the conduit.

A hydrolift including a body is suspended from the bottom of the frame structure for removing debris from the pipeline. Two hydraulic pumps force water and debris cleaned from the pipeline and accumulated along the bottom thereof directly into the body of the hydrolift. Three sets of rotating steel teeth within said body crush and pulverize the debris, forming a slurry which may be pumped to the surface for disposal or released within the conduit for passage through the pipeline.

Multiplexing power cables forming part of the composite umbilical unit connect the apparatus of the invention to the computerized remote control facility. The umbilical unit includes three fiber optic conductors for video, communications and hydraulic/pipe wall pressure data control signals. All members of the umbilical unit are twisted into a single bundle. Polypropylene filler or the like is added to the bundle as necessary to form a cable which is substantially round in cross section. A thermoplastic jacket is extruded over the cable and abraded strength members added prior to encasing the handle of fibers with a final abrasion covering.

Divers may be transported to and from the work site in a one-atmosphere vessel which may be mounted inside the frame structure of the apparatus of the invention. The vessel is a substantially cylindrical double-locked chamber which permits a diver to lock into or out of the outer compartment without flooding the operations compartment. The vessel is self-contained, and provides life support for up to 48 hours in the event support from the surface is interrupted. The apparatus of the invention may be operated from inside the vessel by the divers or from the remote control facility.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are, therefore, not to be considered limiting of its scope, for the invention may admit to other equally effective embodiments.

FIG. 4 is an enlarged, partial view of one of the adjustable legs of the apparatus of the invention;

FIG. 5 is a partial cross-sectional view of the hydrolift of the invention; and FIG. 6 is a sectional view taken along line 6—6 of FIG. 1.

DETAILED DESCRIPTION OF THE PREFERRED EMBODIMENT

Figure 1:
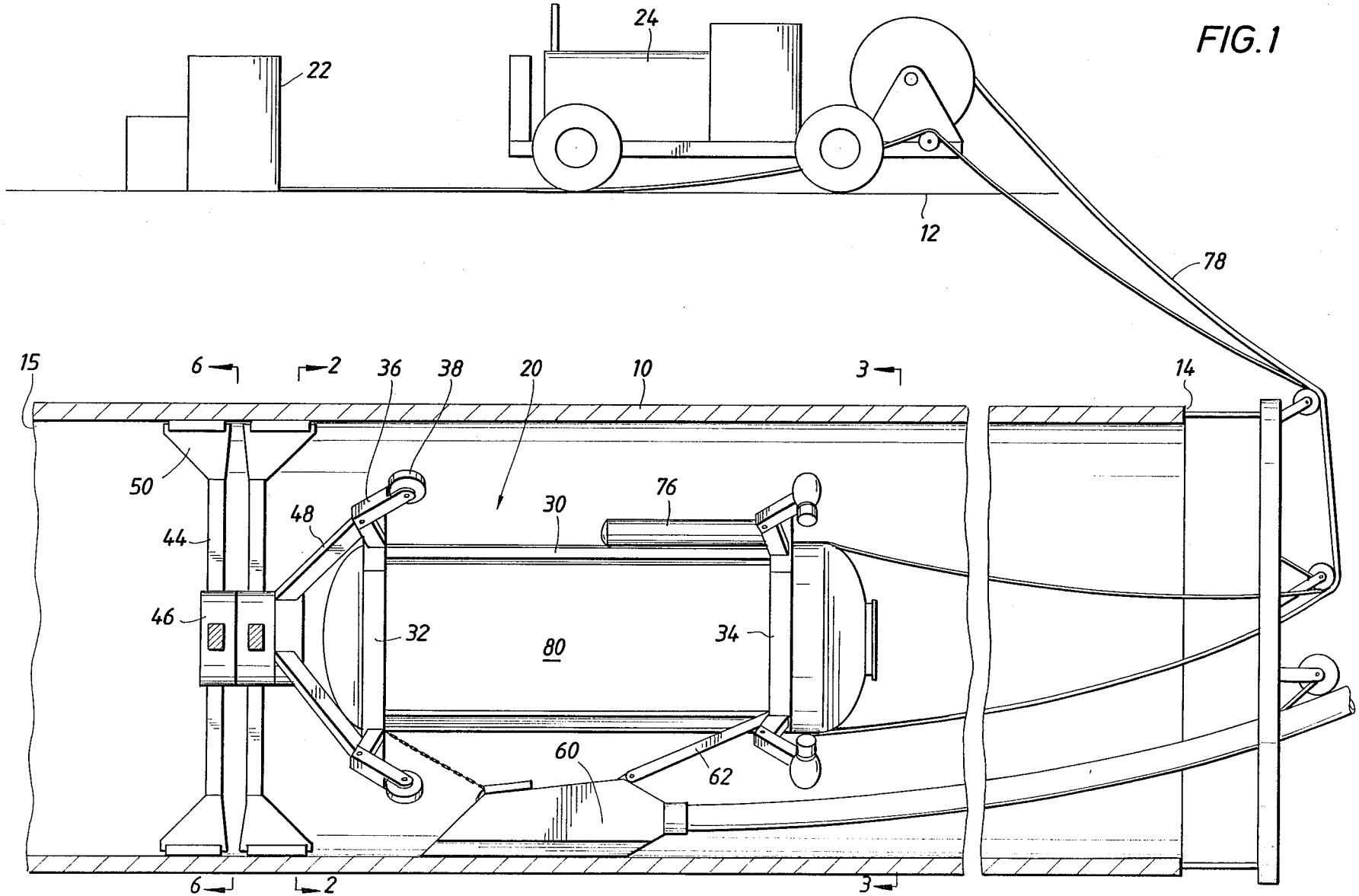
FIG. 1 is a longitudinal sectional view of a portion of a conduit and a partial longitudinal sectional view of the apparatus of the invention positioned within the conduit and connected to the remote control facility.
Figure 2:
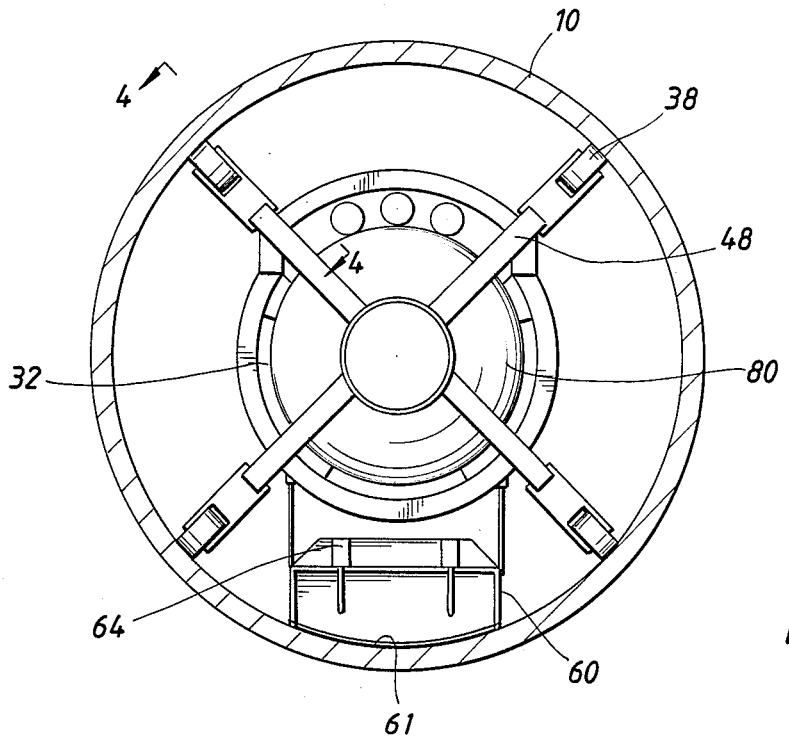
FIG. 2 is a sectional view of the apparatus of the invention taken along line 2—2 of FIG. 1.
Figure 3:
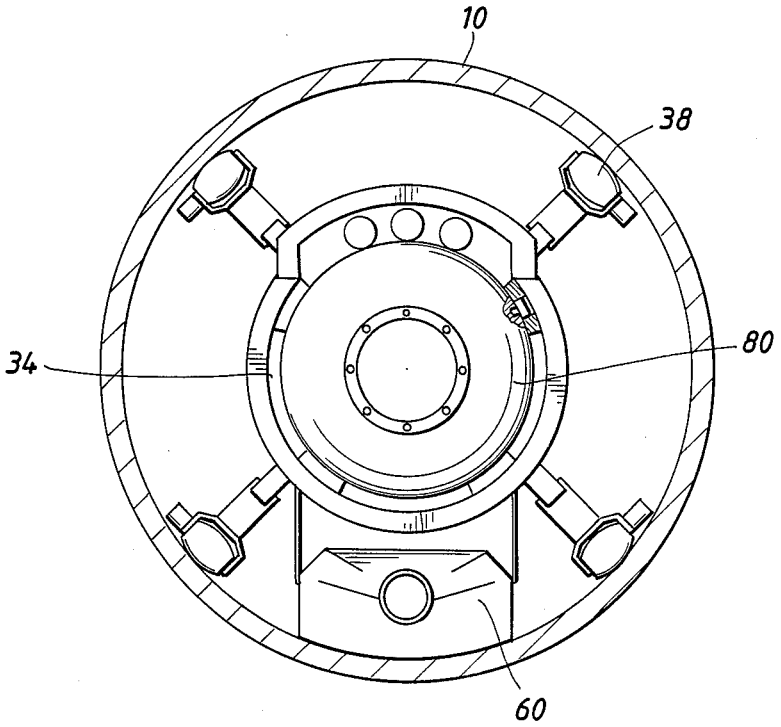
FIG. 3 is a sectional view of the apparatus of the invention taken along line 3—3 of FIG. 1.

Attention is first directed to FIG. 1 of the drawings which shows the general configuration of the pipe cleaning system of the present disclosure. The apparatus of the present disclosure is designed to facilitate cleaning and repair of large diameter pipelines 10 often buried at a predetermined depth below the surface 12 of the earth. The apparatus of the present disclosure is not limited to cleaning pipelines in any particular environment. The pipeline 10 may also be submerged in water, particularly in coastal environments or elevated above the surface 12. A common problem associated with pipelines is the build up of matter which adheres to the inside surface of the pipe forming the pipeline. After a period of time, the pipeline becomes clogged and flow through the pipeline is greatly reduced.

Preparatory to cleaning the pipeline 10, access to the pipeline 10 must be attained so that the apparatus of the disclosure may be placed within the pipeline 10. In the embodiment shown in FIG. 1, the pipeline 10 has been exposed and access provided for the apparatus of the disclosure which is generally identified by the reference numeral 20. Access to the pipeline 10 is provided by removing a section of the pipeline 10 so that an open end 14 of the pipeline 10 is exposed and provides access to the interior of the pipeline 10. The apparatus 20 is positioned within the pipeline 10. In FIG. 1, cleaning of the pipeline 10 occurs from right to left. Therefore, the end 14 is the upstream end of the pipeline 10 and the opposite end of the pipeline 10 is the downstream end 15. In operation, the apparatus 20 moves downstream along the pipeline 10 cleaning the interior thereof in advance of the apparatus 20.

The system of the present disclosure comprises a modular design including the cleaning apparatus 20, a computerized remote control facility 22, an independent power unit 24 and a composite umbilical unit 78. The primary structural member of the apparatus 20 is an elongate cylindrical frame work comprising a plurality of frame members 30. The frame members 30 extend between and are joined to a pair of spaced ring members 32 and 34. The frame members 30 are equally spaced about the ring member 32 and 34 to form an elongate cylindrical frame structure in profile. A minimum of four frame members 30 are preferred to provide structural stability to the frame work of the appartus 20. However, a greater or fewer number of frame member 30 may be used as required for a particular design. The framework of the apparatus 20 is supported within the pipeline 10 by a plurality of adjustable legs 36 which are mounted about the ring member 32 and 34. Drive wheel means are supported by a plurality of said legs 36 and include a wheel 38 mounted to the terminus of each of the legs 36 for engaging the interior surface of the pipeline 10 to insure proper traction therealong to move apparatus 20. The wheels 38 engage the interior surface of the pipeline 10 for advancing the frame member 30 through the pipeline 10. As is well known in the art, the apparatus 20 can be moved in a pipeline 10 by any means desired; for example, such as shown in U.S. Pat. Nos. 3,056,155; 3,230,668, and 4,418,437. The wheels 38 are constructed of an abrasive rubber material or the like to insure proper traction. The legs 36, shown in greater detail in FIG. 4, are moved in and out from the frame work of the apparatus 20 to engage the interior surface of the pipeline 10 by a hydraulic actuator 40 connected to each leg 36. The hydraulic actuator 40 comprises a piston and cylinder arrangement whereby one end of the hydraulic cylinder is pivotally connected to a frame member 30 and the distal end of the piston rod extending from the cylinder is pivotally connected to the leg 36. The hydraulic actuator 40 is a double-acting cylinder whereby hydraulic fluid is directed to one or the other side of the floating piston within the cylinder to move the legs 36 in and out from the framework of the apparatus 20. The legs 36 are pivotally mounted at one end thereof to a framework connector 42 extending angularly outwardly from the ring members 32 and 34. The hydraulic actuators 40 are connected to the power unit 24 via an umbilical cord (not shown in FIG. 4). Any combination, or all eight legs 36 may be extended as required to facilitate agility of the appartus 20 within the pipeline 10.

The pipeline 10 is cleaned by a plurality of hydraulic arms 44 mounted at the forward end of the framework of the apparatus 20. The hydraulic arms 44 rotate about a mounting hub 46. Power means are connected to said hub 46 for rotating said arms 44. As is well known in the art, any desired power source or rotating means can be used to rotate said hub 46; for example, one drive means is shown in U.S. Pat. No. 4,027,349.

A plurality of inwardly extending frame members 48 connect the hub 46 to the ring member 32. The frame members 48 extend inwardly in advance of the framework of the apparatus 20 and position the hub 46 so that the rotational axis of the arms 44 coincides with the rotational axis of the apparatus 20 which is concentrically located within the pipeline 10. The arms 44 are hydraulically extendible to meet the wall of the pipeline 10 and may rotate clockwise or counterclockwise for cleaning a circular conduit. Rectangular conduits may also be cleaned by mounting vertically and horizontally positioned arms which may be reciprocated to clean the interior surfaces of a rectangular conduit.

A wide variety of attachments 50 for maintenance, cleaning and inspection of the pipeline 10 may be attached to the arms 44. The attachments 50 may include video cameras, steel head cutters, wire brushes, paint sprayers and rollers. Non destructive testing equipment may also be mounted on the arms 44.

As material is cleaned from the surface of the pipeline 10, the debris collects along the bottom of the pipeline 10. A hydrolift 60 is provided for removing the debris accumulated in the interior of the pipeline 10. The hydrolift 60 includes a body suspended from the bottom of the frame of the apparatus 20 by connecting members 62. A hydrolift action to remove debris is developed by one or more hydraulic pumps 64 which blow water through nozzles 66 into the hydrolift 60. The hydraulic pumps 64 direct water and debris directly into the body of the hydrolift 60. The debris is subsequently crushed by three sets of steel teeth 68, 70 and 72 supported within said body of the hydrolift 60. The three sets of teeth progressively crush the debris to reduce it to a slurry as it exits the body of the hydrolift 60. A pump 74 positioned at the outlet end of the body of the hydrolift 60 continues the hydrolift action to remove debris and pumps the slurry to the surface through a flexible hose for disposal at the surface. The slurry may also be released within the pipeline 10 to be removed by fluid flow through the pipeline. The forward end of the hydrolift 60 is wedge shaped, as best shown in sectional view of FIG. 5. The bottom of the hydrolift 60 may be formed by overlapping panels (not shown in the drawings) which may be extended to accommodate varying diameters of the pipeline 10. The panels include hydraulic actuators mounted thereon. Upon activation, the actuators force the overlapping panels to spread outwardly relative to each other so that the bottom of the hydrolift conforms to the contour of the pipeline 10. To aid in the removal of debris, a leading edge 61 contacts the surface of the pipeline 10 for scooping up debris from the bottom of the pipeline 10. The exterior of the panels and the leading edge 61 are fabricated of a heavy flexible rubber material for forming a partial seal with the surface of the pipeline 10 ensuring that substantially all the debris is removed from the pipeline 10.

The apparatus 20 is neutrally buoyant to prevent the framework from rotating while the cutter arms 44 are in operation. Buoyancy compartments 76 are provided to maintain the apparatus 20 neutrally buoyant. Torque is controlled by counterrotating the cutter arms 44.

The hydraulics of the apparatus 20 are powered by submersible electric motors mounted on the frame. The motors are powered from the surface by a generator connected via multiplexing power cables forming a part of the composite umbilical unit 78 extending from the remote power unit 24. The composite umbilical unit 78 includes fiber optic conductors for transmitting video, communications, and hydraulic/pipe wall pressure data control signals. The composite umbilical unit 78 is twisted into a single bundle using polypropylene filler as necessary. A thermoplastic jacket is extruded over the bundle and an abraded strength member is added prior to a final abrasion protection covering which enables the composite umbilical unit 78 to be pulled behind the apparatus 20 without damage to the fiber optic conductors.

Referring again to FIG. 1, a one-atmosphere vessel 80 is shown supported within the framework of the apparatus 10. The vessel 80 is detachable from the framework and is designed to transport divers to and from a work site within the pipeline 10. The vessel 80 includes a double locked chamber which allows a diver to lock into or out of the outer compartment without flooding the operations compartment of the vessel 80. The vessel 80 is self-contained and provides life support, in the event that life support from the surface is interrupted. The vessel 80 provides a safe, dry, on site diver support facility. Operation of the apparatus 20 may be directed from the vessel 80 by divers or other personnel.

Operation of the apparatus 20 is typically directed from the remote control facility 22 located on the surface. The remote control facility 22 is provided with micro computers, video monitoring and a continuous real time data acquisition system, which provides abiotic, physical and mechanical data measured within the pipeline 10 and transmitted to the remote control facility 22.

While the foregoing is directed to the preferred embodiments of the present invention, other and further embodiments of the invention may be devised without departing from the basic scope thereof, and the scope thereof is determined by the claims which follow.

What is claimed is:

1. Apparatus for cleaning the interior of conduits comprising;

(a) a frame;

(b) support means mounted to said frame for engaging the inner surface of a conduit and positioning said frame coaxially within a conduit;

(c) a cutter head assembly rotatably mounted on said frame for cleaning the inner surface of a conduit and forming debris;

(d) wheel means mounted on said support means for advancing said frame through the conduit;

(e) means for rotating said cutter head assembly;

(f) means for removing debris from the interior of the conduit;

said means for removing debris comprising a hydrolift body suspended from the bottom of said frame, and said hydrolift body including a forward end and outlet end, said forward end having a forward edge for scooping up debris from the bottom of a conduit.

2. The apparatus of Claim 1 wherein said hydrolift body includes hydraulic pumps mounted thereon for directing water and debris into said hydrolift body, said hydrolift body further including a plurality of teeth supported within said hydrolift body for crushing and pulverizing the debris passing therethrough.

3. A combination as set forth in claim 1 including nozzle means positioned to direct water into the forward end of the hydrolift body above said forward edge for forcing debris into the hydrolift body, teeth means supported in said hydrolift body for crushing debris passing into said hydrolift body, pump means connected to said outlet end of said hydrolift body for pumping crushed debris and water out of said hydrolift body, and flexible hose means connected to the pump means for carrying said crushed debris and water away from said hydrolift body.

4. A combination as set forth in claim 3 wherein said teeth means comprise a plurality of sets of rotating teeth, said sets of teeth progressively crushing the debris to reduce it to a slurry.

5. A combination as set forth in claim 3 wherein hydraulic pump means are mounted on said hydrolift body, said hydraulic pump means directing water to said nozzle means.

6. Apparatus for cleaning the interior surface of a conduit by removing foreign material and forming debris therein, said apparatus comprising a framework for being supported within a conduit, support means connected to said framework for engaging the interior surface of a conduit for movably supporting said framework therein, means for moving said framework in a conduit, rotatable means mounted on said framework for contacting a foreign material and removing it from an interior surface of a conduit forming debris therein, removal means for removing the debris formed in a conduit, said removal means comprising a hydrolift body having a forward end and an outlet end, means suspending said hydrolift body from the bottom of said framework, said forward end of said hydrolift body including a forward edge for scooping up debris from the bottom of a conduit, hydraulic pumps mounted on said hydrolift body, nozzle means on said hydraulic pumps for blowing water into the forward end of said hydrolift body to force water and debris into the hydrolift body, crushing means in said hydrolift body for crushing debris and forming a slurry with the water, and pump means connected to the outlet end of the hydrolift body to pump the slurry from the hydrolift body for disposal.

7. A combination as set forth in claim 6 wherein said crushing means comprises a plurality of rotating teeth to progressively crush debris to reduce it to a slurry.

8. A combination as set forth in claim 1 wherein the forward end of the hydrolift body is wedge-shaped.

9. A combination as set forth in claim 7 wherein said plurality of rotating teeth include three sets of rotating teeth located between said forward end and said outlet end of said hydrolift body.

* * * * *